United States Patent [19]

Eckels

[11] 4,109,576

[45] Aug. 29, 1978

[54] SHAPED CHARGE WITH ENHANCED PENETRATION

[76] Inventor: Robert E. Eckels, 2101 Youngfield, Golden, Colo. 80401

[21] Appl. No.: 726,732

[22] Filed: Sep. 27, 1976

Related U.S. Application Data

[63] Continuation-in-part of Ser. No. 587,911, Jun. 18, 1975, abandoned.

[51] Int. Cl.[2] ..... F42B 3/08

[52] U.S. Cl. ..... 102/24 HC

[58] Field of Search ..... 102/20, 24 HC, 56 SC

[56] References Cited

U.S. PATENT DOCUMENTS

| | | | |
|---|---|---|---|
| 2,628,559 | 2/1953 | Jasse | 102/24 HC |
| 2,960,930 | 11/1960 | Bell | 102/24 HC |
| 2,980,018 | 4/1961 | Turechek | 102/24 HC |
| 3,348,482 | 10/1967 | Keener et al. | 102/24 HC |
| 3,732,817 | 5/1973 | Thomanek | 102/24 HC |
| 3,777,663 | 12/1973 | Brown | 102/24 HC |
| 3,894,489 | 7/1975 | Riedl et al. | 102/24 HC |

FOREIGN PATENT DOCUMENTS

| | | | |
|---|---|---|---|
| 618,618 | 2/1949 | United Kingdom | 102/24 HC |

*Primary Examiner*—Verlin R. Pendegrass
*Attorney, Agent, or Firm*—Richard D. Law

[57] ABSTRACT

A diverging, smooth wall stand-off for an explosive shaped charge aligns generated gases into smooth flow enchancing of the formed jet substantially increasing the jet length effectively, the jet penetration, increasing the cleanliness of the developed hole, and the like. The shape of the stand-off to produce the enchancement is a frusto-conical tubular device, and preferably extends from about 13° included closing angle at about 1.5 conical cavity diameters to about 30° included closing angle at about 0.6 conical cavity diameters. The base of frusto-conical stand-off coincides with the base of the cavity of the shaped charge and the small end of the stand-off has an area of about two-thirds of the base. A small range on either side of the optium or preferred frusto-conical stand-off provides a highly effective enhancement for the shaped charge.

17 Claims, 14 Drawing Figures

SHAPED CHARGE WITH ENHANCED PENETRATION

This application is a continuation-in-part of my copending application Ser. No. 587,911, filed June 18, 1975 for EXPLOSIVE SHAPED CHARGE, and now abandoned.

This invention relating to improved shaped charges for a smooth wall stand-off provides a gradually developed constriction from the base of the shaped charge cavity increasing the velocity of the gases developed by the detonation, aligning the gases into smooth flow, and increasing optimum jet length and penetration without increasing the quantity of the explosive charge.

PRIOR ART

Explosive shaped charges have been known for a substantial period of time. Such charges are used extensively in rather limited and well defined areas, including certain types of ordnance devices. Extensive use of shaped charges has not been found for general construction purposes, because of their relatively high cost in comparison to the unit of rock broken. Such a similar reason is, also, a limitation on their use in mining and other areas of high volume explosive use, primarily for breakage and secondarily for excavation. However, the literature of high explosive indicates that explosive shaped charges inherently may have advantages which could bring extensive use of such charges, if the cost of the charges were reduced in relation to their performance. Thus, with improved performance, the explosive shaped charges have greater utility in extended areas.

The patent literature is replete with all types of shaped charges and their use, including the composition of the explosive material, the manufacture of the housing, cone, seals, etc. Attention has been directed to the configuration of the construction of the explosive container and the charges itself, for example, in U.S. Pat. No. 3,079,861 utilizes a sintered metal stand-off support, which is part of the casing for the charge. The object is to pulverize the support and eliminate large pieces of metals on detonation of the charge. In U.S. Pat. No. 3,021,784, the stand-off is made of rubber spacing means with no means for a charge alignment. In U.S. Pat. No. 3,244,101 an alignment means is provided for a shaped charge; however, a heavy plate is provided below the shaped charge for catching the carrot which results from the explosion. This is not for increasing hole penetration and, in fact, does produce a good deal of interference and turbulance in the jet and gases, decreasing penetration.

U.S. Pat. No. 3,416,449 describes an ordnance warhead using an explosive section with two cavities, one following the other on an axial alignment. U.S. Pat. No. 3,149,102 shows an attempt to gain an explosive power from a flat surface using heavy plates, but since this is not a shaped charge, it it merely an attempt to consolidate an explosive front. U.S. Pat. No. 3,750,582 is an ordnance warhead using tandum charges in attempt to provide increased penetration with one explosion following another explosion. In U.S. Pat. No. 3,855,929 a linear shaped charge is disclosed as being mounted in a one piece extruded metal housing to provide a linear shaped charge.

U.S. Pat. No. 3,777,663 describes a removable stand-off which may be attached in the field, and by tapering the stand-off, they may nest for storage and shipping. The stand-off device is formed of thin metal. It is fluted and provided with annular indentations to strengthen the thin metal, removable stand-off. In U.S. Pat. No. 2,628,559 a flat coned and center-extension stand-off construction is shown to provide placement of the shaped charge. By providing the extension to the cone, it fits in a small bore hole and is thus centered. The flat cone generally give substantially less penetration than a shaped charge without such a cone. Further, the flat coned placement member is placed a substantial distance away from the shaped charge cone which negates enhancement and reduces penetration.

In U.S. Pat. No. 3,894,489 there are shown two sloped walls which includes the rather wide angle of 45.5° at a stand-off of about 0.66 diameters. It appears that the tight closure may be intended to consolidate particles within the area of the following explosive tubular section. The patent notes that the guiding sleeves attain the effect of even the very thin walls, so that the secondary explosive contribution is related to the stand-off. The British Pat. No. 618,618 separable stand-off closure is shown which has an angle of about 15° at a stand-off of 1.1 diameters. The description, however, describes the device as an ogival shaped water type container. No enhancement effect is attributed to the construction of the stand-off.

THE INVENTION

According to the present invention, there is provided an aligning means for a Munroe effect jet for a lined cavity shaped charge which substantially increases penetration of the jet and improves the shape of the produced hole from the jet. The effect is to provide an initially low cost enhancement of a shaped charge which improves reliability as well as improving the overall performance of the explosive device. In addition to the improvement of the jet from a lined cavity shaped charge, a channelling effect for gases from an explosive charge substantially increases the detonation velocity of the explosive providing still further enhancement of the produced Munroe effect jet. The invention provides a tubular type enhancement means for consolidating involved gases providing a laminar flow of the gases along with the jet, and thereby permit development of the jet along its full length and to provide alignment of the jet for producing the enhanced desired result in the target material. The device utilizes some of the energy which is not now extracted in the jet formation and thereby produces greater penetration without an increase of charge. The increased velocity of the gases which accompany the jet are aligned into a more ordinary laminar flow along with the jet. The invention provides, somewhat like the upstream side of a venturi, an increase of the velocity with a reduced upstream turbulance and fewer downstream eddies, or their equivalents, in the gas. The body of the enhancement section, for a conical cavity shaped charge, is usually around and may be a part of the casing of the explosive charge itself. The internal wall of the stand-off is smooth along its axial length and is of a general frusto-conical shape and preferably has a closing angle related to the length of the stand-off (stated in conical cavity diameters). The angle extends from about 13° included closing angle at about 1.5 conical cavity diameters, to about 30° included closing angle at 0.6 conical cavity diameters. However, since the produced jet is quite fragile on a lateral basis, even though very powerful on an axial basis, the produced jet must not contact the wall of the stand-off. The stand-off may be enclosed within a perpendicular cylindrical closure with no enhancement effect on the jet. Included among the objects and advantages of the present invention is to provide an improved explosive shaped charge having a higher efficiency in produced jet penetration.

Another object of the invention is to provide an integral stand-off for a lined cavity shaped charge, which aligns formed gases with the produced jet to increase the velocity of the jet and substantially improve the penetration of the jet from the shaped charge.

Yet another object of the invention is to provide an improved underwater, explosive shaped charge with increased jet penetration.

Still another object of the invention is to provide an explosive shaped charge which produces an improved hole shape from the generated jet.

Yet another object of the invention is to provide economical stand-off means for shaped lined conical cavity explosive containers, which includes booster aligning means for the explosive means.

These and other objects and advantages of the invention may be readily ascertained by referring to the following description and appended illustrations in which.

Figure 1:
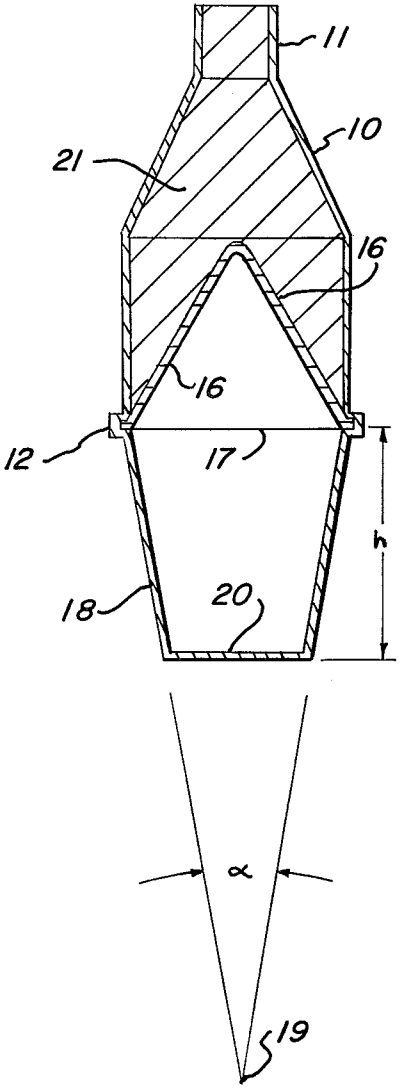
FIG. 1 is a side elevational view, in section, of an explosive shaped charge incorporating the stand-off of the invention.

In the device illustrated in FIG. 1, a relatively simple shaped charge is provided with a housing 10 having a conical, lined cavity 16 closing one end of the housing and contacting a mass of explosive material 21 which may be charged through the opening or neck 11. Preferably the conical liner is a 60° cone made of heavy metal, as for example, steel, copper, etc. The housing 10 is provided with a shoulder 12 which seals with a lip on the wall of a stand-off and support 18. The bottom or smaller end of the truncated closure 18 is closed by an end wall 20 which is approximately two thirds of the diameter of diameter 17 which is the diameter of the cone 16. The opposed sides of wall 18 converges at included closure angle alpha which is related to the height h of the stand-off calculated in diameters of the cone 16. This height is measured between the diameter 17 and closure 20. The phantom apex 19 of the phantom extension of the walls will be at varying distances from the closure 20 related to the included angle alpha. With the charges to be used underwater, the seal at 12 around the stand-off 18 and the housing 10 must be satisfactory to prevent any leaking, and, of course, the stand-off closure 20 must be strong enough to stand the pressure that the device is to be subjected.

Figure 2:
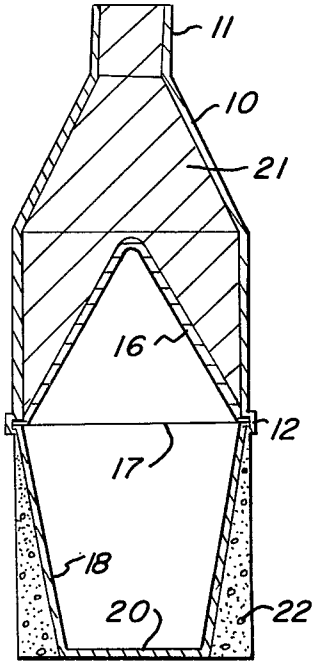
FIG. 2 is a side elevational view, in section, of a slightly modified form of the devices of FIG. 1 using a concrete reinforced stand-off.

The strength of the enhancer must be sufficient to retain the evolved gases within the chamber until the generated jet perforates the bottom or leaves the bottom opening. As shown in FIG. 2, the device of FIG. 1 may be provided with a reinforced wall reinforcing the wall 18, as for example, by a concrete wall 22. In this case, the exterior wall of the reinforcing 22 is generally coincidental with the exterior wall of the container 10 extending downwardly from the cone. With a reinforcing such as concrete 22, the wall 18, which is normally preferably metal, may be replaced with paper or other material for forming the smooth inside surface while being backed by the reinforcing around the exterior of the enhancer.

With the properly designed enhancer the configuration extends a jet penetration into hard rock to about 166% of unenhanced in air to in excess of 200% underwater. In both cases the stand-off is about 1 cone diameter along the longitudinal axis with an enhancer having a closing angle of about 19°. When formed of concrete the reinforcing wall 22 may, also, provide weighting material for the shaped charge for underwater use, as well as providing strengthening of the wall.

Figure 3:
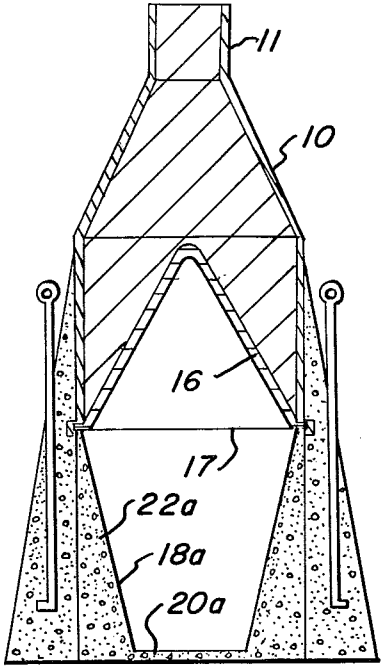
FIG. 3 is a cross-sectional side elevational view of a still further modified form of the shaped charge showing a weighting of the charge for underwater use.

The device is further modified, FIG. 3, by providing a stand-off formed by concrete 22*a*, which has a smooth inside surface 18*a*, and a bottom 20*a*. This bottom is approximately two thirds the area of 17, which is the base of the cone 16. The charge is further weighted by means of an external concrete housing 24, which may be of any desired shape, and into which handling lugs 25 may be embedded for handling the heavy charges. The mass of the enhancer side walls is important in air, or in water. The increased mass increases the enhancement, but this increased effect is less important than the angle and the wall strength, and it does provide a centering effect along with the strength and the proper angle. The effectiveness of mass seems to relate to shock transmission, but it seems to have other characteristics of containment accounting for the increased enhancement. The quantity of the concrete may be readily adjusted to meet the particular requirements of the weight, buoyancy effect, etc. of the shaped charge with the closed stand-off.

Figure 4:
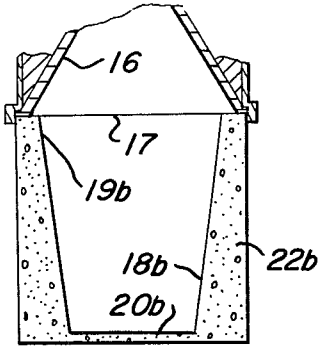
FIGS. 4 and 5 are side elevational fragments of a configuration of the stand-off according to the invention showing the relation of the size of the stand-off aperture at the cone base of the charge.
Figure 5:
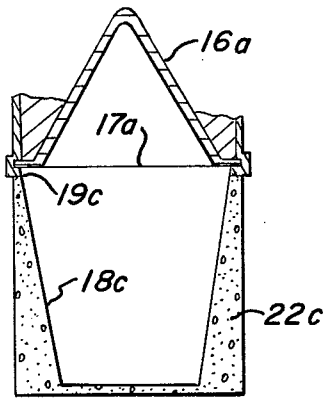

It is not necessary that the base of stand-off cavity of the stand-off match exactly the base of the conical cavity of the charge. As shown in FIG. 4, the maximum diameter 19*b* of the stand-off support 22 is less than the maximum or base diameter 17 of the conical cavity liner 16. In this case, the stand-off is formed of concrete and includes wall 22*b* with smooth interior surface 18*b* of the same configuration as the metal stand-off of FIG. 1, in relation to closing angle of the sides of the frustoconical stand-off, the height of the stand-off and the area of the closure 20*b*. The smaller diameter of the stand-off 20*b* is formed of the same material as the side wall 22*b*. In a similar manner, the stand-off may be provided with a somewhat larger base or maximum opening than the base or maximum diameter of the cone, as shown in FIG. 5. In this case, the diameter 19*c* of the stand-off is somewhat larger than the base opening 17*a* of the cone 16*a*, and the inner wall surface 18*c* converges at an included angle within the range to join the concrete closure 20*c*. The diameter of the closure 20*c* is approximately two-thirds of the diameter of the base or maximum diameter 17*a* of the cone 16*a*. It is preferred that the maximum diameter of the stand-off be not less than 80% of the maximum diameter of the cone nor the maximum diameter of the cone be less than 80% of the maximum diameter of the stand-off. The height relation to the closing angle is the same, and the smaller closure are about two thirds of the large diameter of stand-off.

The charge has been shown in a metal housing 10, with the metal cone 16 and with the metal stand-off 18 to provide a readily manufactured device. Such a device is highly useful for liquid explosives, which may be charged in the field immediately prior to use. The container, however, may be made completely of concrete with a metal cone 16 mounted in proper position, dividing the explosive container portion from the stand-off portion. The cavity of the stand-off must still fall within the angle and stand-off height necessary to produce the enhancement as set out in the application. Further the inside wall must be lineally smooth.

Figure 6:
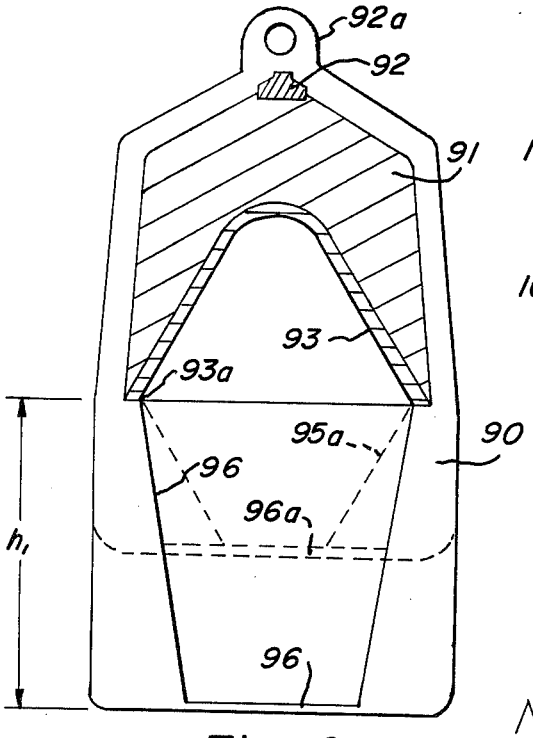
FIG. 6 is a side elevational view, in section, of a form of an oil well perforating charge using a solid explosive, such as RDX.

A charge, such as shown in FIG. 6, is of a type useful for oil well perforating and includes a body 90 having a charge of solid explosive 91 pressed into the cavity above a metal cone 93. This cone has a maximum diameter 93*a* and is nominally a 60° cone. The top 92 provides for closure of the explosive compartment 91 and includes a detonator cord bail 92*a*. The container body 90 includes a cavity with a wall 95 converging at an included angle within the range of the invention, and where the closure wall 96 is approximately two-thirds of the area of base 93*a* of the cone. The stand-off height h, should be about 1 diameter, with the walls 95 converging at an included angle of about 19°. Where it is desired to have a shorter overall length charge, a closure 96*a* may be provided, of about the same area as area 96 or two-thirds of area 93*a*, with the wall 95*a* converging at about a 35° included angle.

Figure 7:
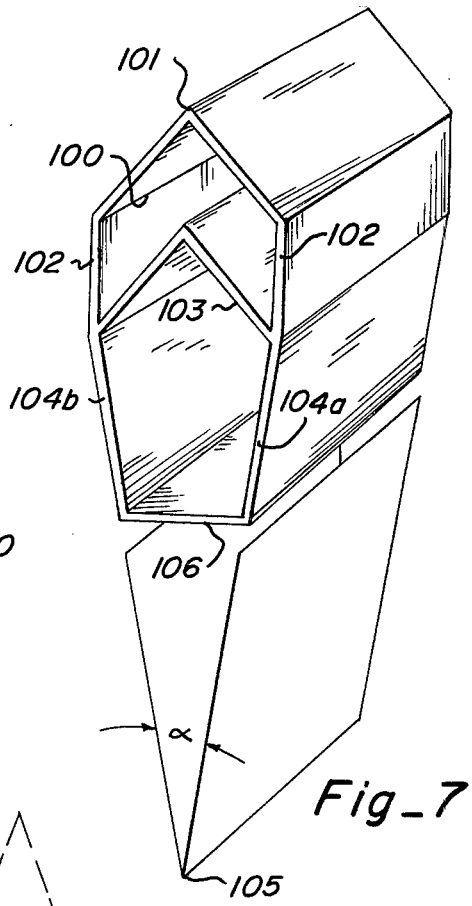
FIG. 7 is a generally perspective view of a lineal shaped charge housing, formed as an extrusion, providing a container for the explosive and the stand-off according to the invention.

The enhancing of a shaped charge is applicable to a linear shaped charge, illustrated in FIG. 7, wherein a chevron shape cavity 100 includes a peak 101, sides 102 and a metal cavity liner of peaked shape 103 which is as about a 60° angle. A stand-off is provided with a wall 104*a* at one side and a wall 104*b* which converge at an angle alpha which is the included angle of the converging to an apex 105. The walls 104*a* and 104*b* may be closed by a closure 106 which has a width of approximately two-thirds the width of the distance across the maximum width of the cavity 103. With a stand-off having its small closure 106 at approximately the same distance as the maximum width between the ends of 103, the walls 104*a* and 104*b* will converge at about a 19° angle. Not shown are end closures and initiating means.

Figure 8:
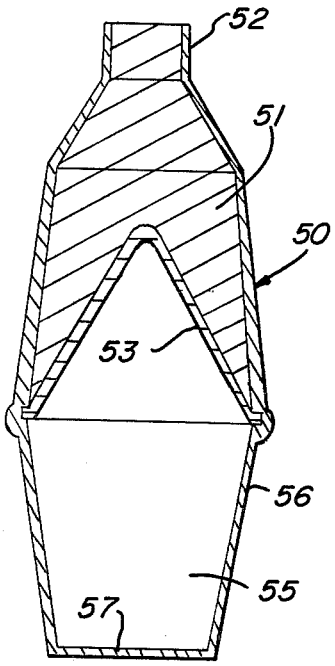
FIG. 8 is side elevational view of combined charge housing and stand-off according to the invention.

A modified shaped charge container and stand-off is shown in FIG. 8, wherein a reinforced fiberglass plastic container, shown generally by the number 50, includes an explosive chamber 51, containing an explosive, and neck 52 for filling the same. A 60° metal cone 53 is mounted in the housing separating the explosive chamber 51 from a stand-off portion 55. This includes a frustoconical wall 56 whose base coincides with the base of the cone 53. A small closure 57 of about two-thirds of the cross-sectional size of the base of the cone 53 closes the stand-off. The wall 56 converges at about an included angle of 19° at a distance of one cone diameter between the base of cone 53 and the closure 57.

Figure 9:
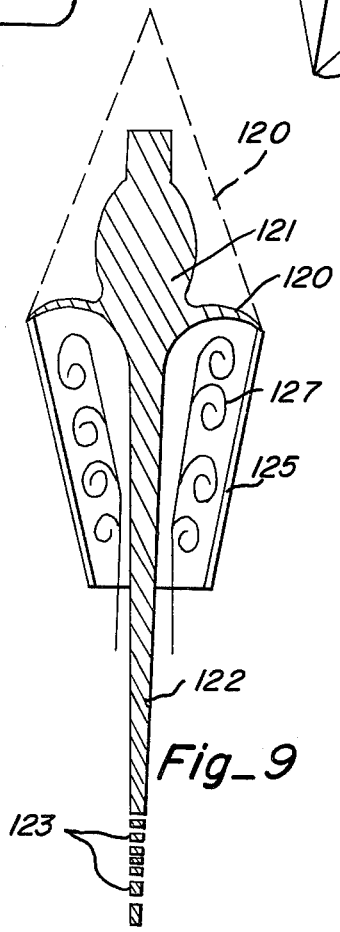
FIG. 9 is a schematic representation of the jet produced by a lined cavity shaped charge according to the invention.

The method of enhancement of a formed jet by the stand-off according to the invention, is generally illustrated by FIG. 9, which represents the formation of a jet and the slug, or carrot, from the liner of the charge, during the jet formation. The jet or carrot 121 forms when a metal 120 cone collaps at generally a constant velocity, as a result of the explosive front of the charge that is in contact with the outer surface of the original cone, shown generally by dash lines 120. As the explosion front proceeds through the explosive, the wall of the conical liner fluidifies and collapses to form the carrot 121 and an elongated jet 122 of extremely high velocity liquid metal. The tip of the jet includes fragments 123 of the liquid metal, and these are responsible, along with the jet 122, for producing the hole formed by the shaped charge. The converging wall of the enhancer 125 of the stand-off confines the generated gas 127 and aligns the gas with the jet producing a laminar flow which increases the jet veolcity, strength, and its length for better penetration. This, also, provides for maintaining the jet conformation continuously as the explosion front extends from top to bottom of the cone. The net effect of this stand-off, is to increase the velocity of the jet, while forming a longer cohesive jet. Thus, the penetration is substantially greater than the shaped charge without the enhanced stand-off. By having the bottom diameter of the enhancer stand-off, where the jet must exit, at about two-thirds of the diameter of the cone maximum diameter and by aligning it, the enhancer with the axis through the shaped charge cone, the jet will be enhanced. It is important that the bottom diameter of the enhancer be sufficiently great that the jet does not contact the sloped wall. While the jet is longitudinally quite powerful, it is laterally fragile and can be easily disrupted.

Figure 10:
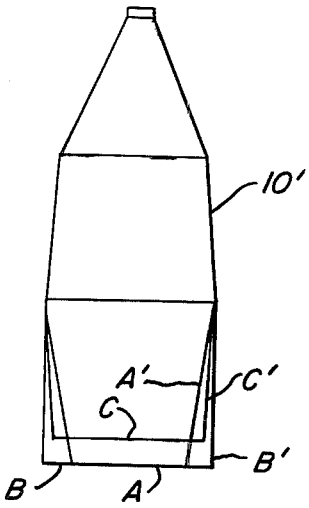
FIG. 10 is a schematic showing of the configuration relationship of a shaped charge and various stand-offs with various included angles and height of the stand-off.
Figure 11:
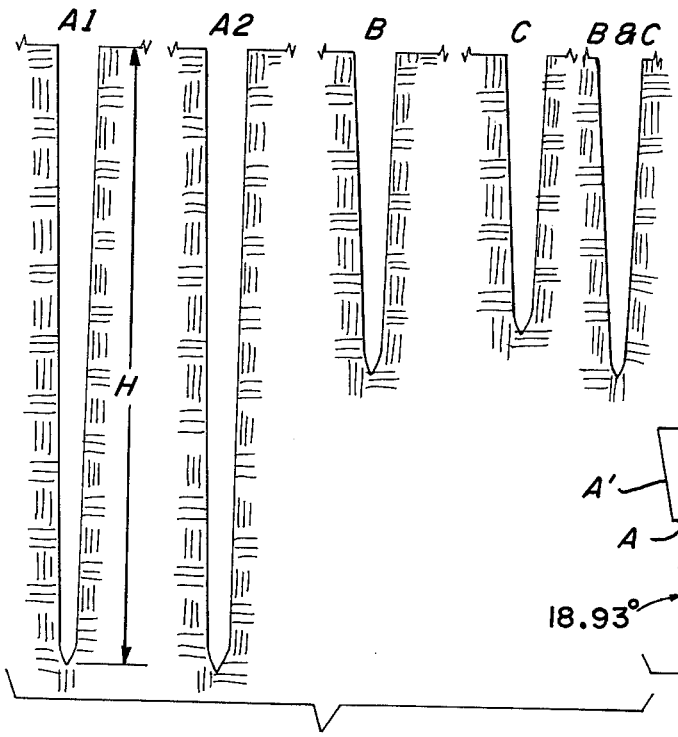
FIG. 11 is a cross-sectional schematic view of the penetrations produced by shaped charges with particular types of stand-offs.
Figure 12:
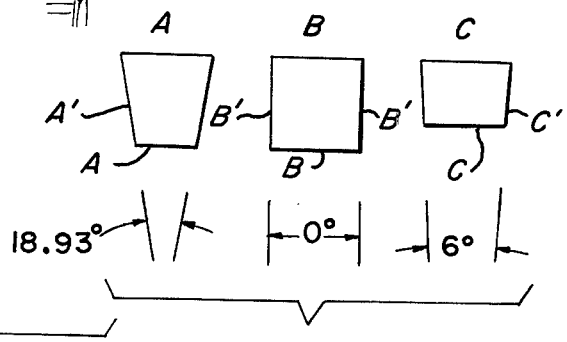
FIG. 12 is a schematic representation of the stand-off configuration of the enhanced stand-off of the invention in relation to prior art stand-off.

The schematic showing of FIG. 10 illustrates the relationship of different stand-off configurations with a 9 inch diameter cone for a shaped charge 10'. The configuration of the stand-off determines actual target penetration, as shown in FIG. 11. For a generally conventional stand-off B', the configuration is shown separately in FIG. 12, including vertical sides B' with the base B at about 1 cone diameter below the maximum diameter of a 9 inch cone shape charge. As clearly shown in FIG. 12, the parallel side walls do not converge but run in parallel relation. An enhancer A is provided with side walls A' which have an included angle of 18.9° to a base A which is at 1.0 cone diameter from the maximum diameter of the 9 inch cone. The stand-off C is provided with a base C of approximately the same as the diameter of the base of the cone with the stand-off wall C' converging at an included angle of 6°. Each of the explosive charges were approximately the same weight and each had near identical 9 inch diameter cones, having 60° steel conical cavities.

The following are the results of actual testing using nitromethane as the explosive. A 9 inch diameter charge with a stand-off of a configuration of A was detonated into a quartsite, and as shown in A1 of the cross-section it had a penetration H of about 6.67 cone diameters into the quartsite. A charge of the C configuration stand-off and a charge with a B configuration stand-off was fired into similar quartsite. As shown by the B and C cross-section the charge with a C configuration penetrated 3.7 cone diameters into the quartsite, and the charge with the B configuration stand-off penetrated 4.0 cone diameters into the same quartsite. A similar charge with a similar 9 inch diameter cone with an A configuration was then fired into limestone as shown by A2, and it had a 6.86 cone diameter penetration. A similar charge with a B configuration stand-off was fired into similar limestone and it had a 3.43 cone diameter penetration. A charge with a stand-off of the C configuration was fired into similar limestone, and its penetration was only 3.11 cone diameters. This shows the enhancement value of the cone according to the invention.

Figure 13:
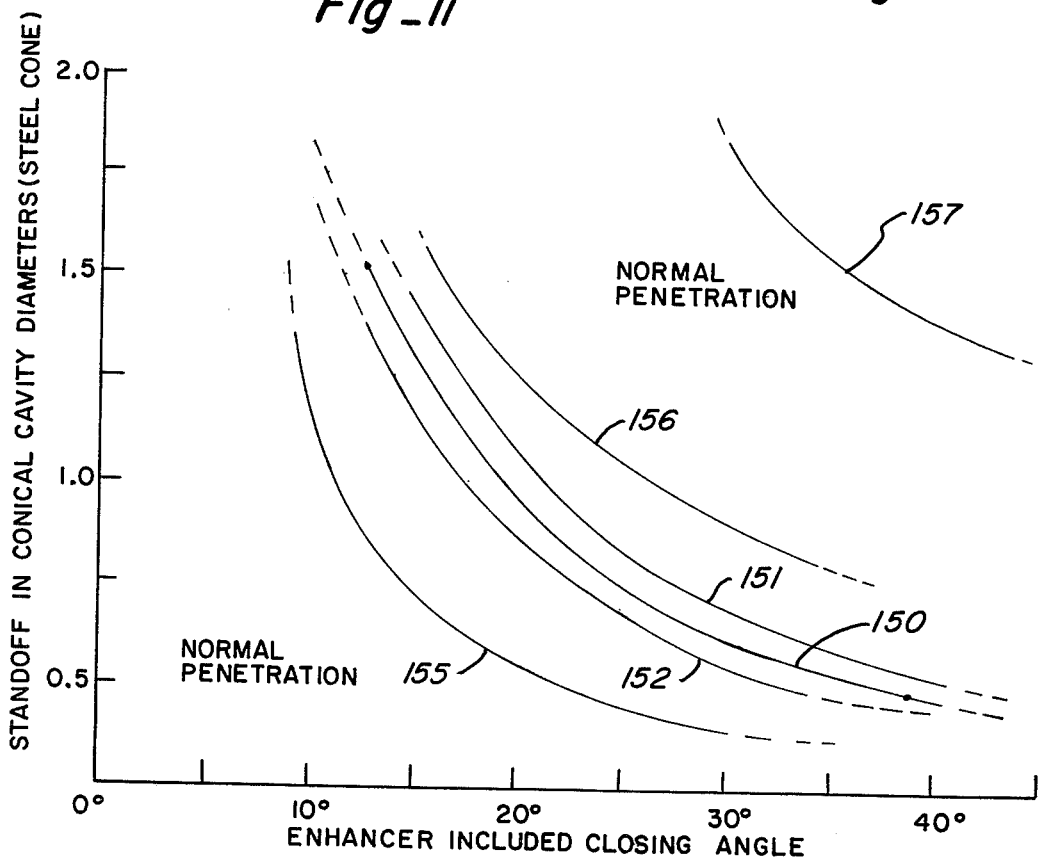
FIG. 13 is a graph of the dimensions of stand-off represented by conical diameters against the enhancer included closing angle.
Figure 14:
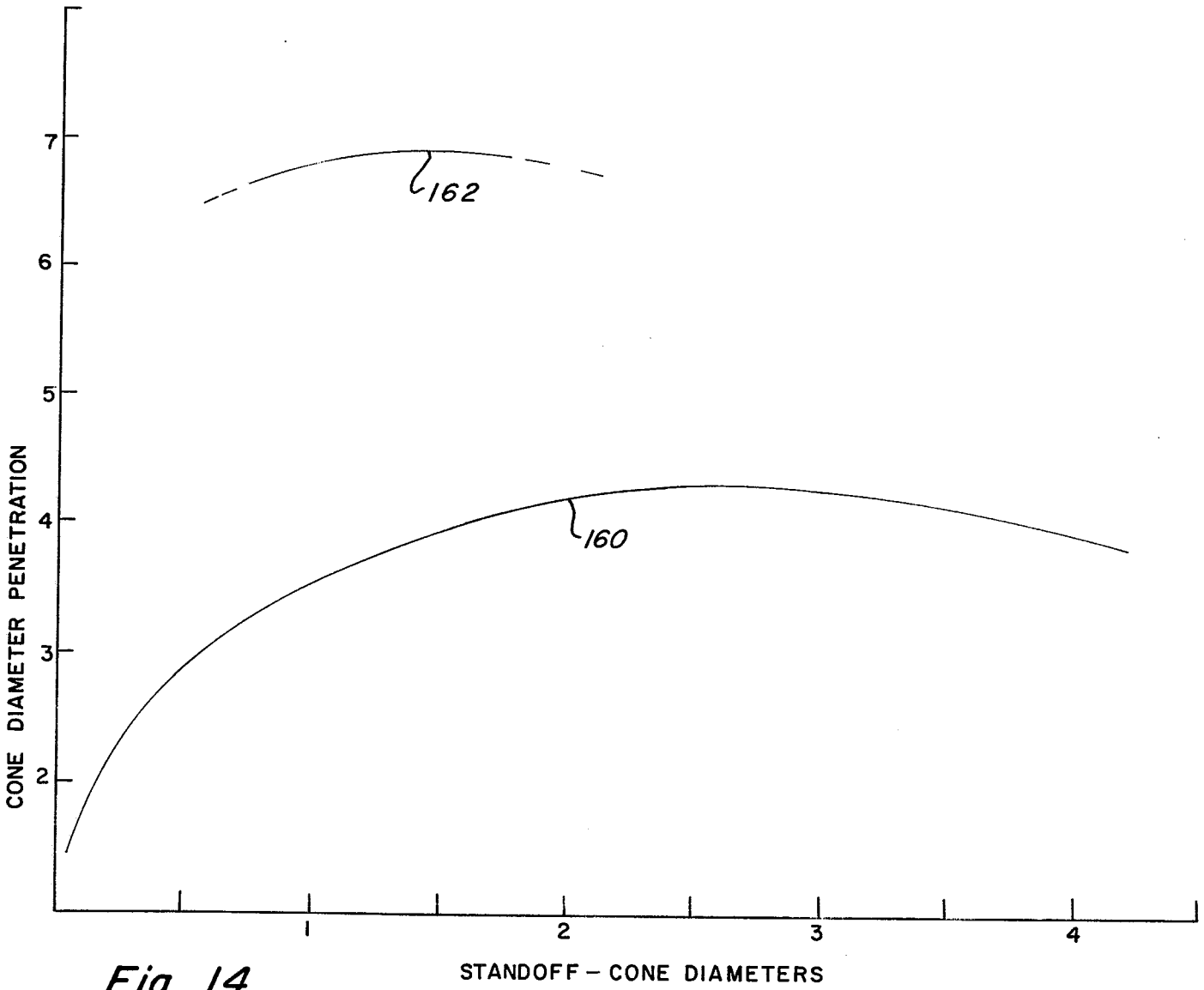
FIG. 14 is a graph of the penetration into granite with shaped charges provided with the enhancer according to the invention and conventional shaped charges, with each of the shaped charges having a 60° steel cone with a 9 inch diameter.

A series of tests were run to produce a curve 150, FIG. 13, which extends from about 1.5 cone diameters at about a 13° closing angle to a 0.5 diameter at about a 37° closing diameter. This line was found to be the optimum penetration of the charge and the preferred configuration of the enhancer with the closure about two-thirds of the conical cavity base. An optimum upper range has a curve 151 which generally parallels the preferred optimum line and an optimum lower range curve 152 which provides a range in the preferred optimum configuration. A lower fringe curve 155 shows the fringe enhancement between normal penetration in the area to the left of that curve, while an upper fringe curve 156 defines the range of a normal penetration up to a curve 157 above and to the right of that curve 156. When a closed cone stand-off is used, with no stand-off below normal penetration is experienced, as shown by the curve 157, which is below the normal penetration area above the upper fringe curve 156. Actual penetration in granite is shown in the curves of FIG. 14, using a 60° steel cone shaped charge with a 9 inch diameter. The curve 160 shows a characteristic granite penetration using a normal stand-off as shown by the prior art. As the stand-off height from the target approaches zero the penetration into the granite is decreased substantially. The normal maximum of about 4.2 diameters penetration is achieved at near 2½ cone diameters stand-off, with vertical sides of a stand-off, or in air without any walls. The enhanced stand-off penetration is shown in curve 162 showing that in the entire range of from about ½ cone diameter stand-off to about 2 diameters stand-off, the actual penetration is substantially greater than the penetration without an enhanced shaped charge shown by the curve 160. Also, is noted that the maximum penetration with the standard stand-off is achieved at about 2½ cone diameters while the maximum penetration of the enhanced charge is achieved at about 1 to 1½ cone diameters. This, of course, indicates an economical production of a stand-off with this configuration, reducing the quantity of materials to support a shaped charge to produce maximum penetration with no increase in explosive material.

What is claimed is:

1. A shaped explosive charge enhancement and stand-off structure in which the shaped charge has a cone on the order of about 60°, comprising in combination with a housing for the explosive having the cone lined.

(a) a frusto-conical rigid structure having its small end about two-thirds of the diameter of the base of the cone and perpendicular to the longitudinal axis of the cone, and its larger end about the same area as the base of the cone and perpendicular to the longitudinal axis of the cone and arranged to register with the base of the cone, (b) the longitudinal axis of the frusto-conical structural being coincidental with the longitudinal axis passing through the cone, (c) the inside wall of said frusto-conical structure being smooth in a longitudinal direction, so as to provide an unhindered path for gases travelling longitudinally along the wall, (d) means for securing said structure to the shaped charge, and (e) the inner wall of said structure converging from its large to its small end at a closing angle ranging from about 8°–17° at 1.5 cone diametes stand-off to a closing angle of about 30° at from about 0.9 to 0.4 cone diameters stand-off and arranged so that no portion of a generated jet particulates contacts the inner wall, and the velocity of the generated jet is increased to produce substantially increased penetration in a target material.

2. A shaped explosive charge enhancement and stand-off according to claim 1, wherein:

said frusto-conical rigid structure is formed of metal.

3. A shaped explosive charge enhancement and stand-off according to claim 1, wherein:

said frusto-conical rigid structure is waterproof and arranged to withstand the depth of water under which the charge is to be used.

4. A shaped explosive charge enhancement and stand-off according to claim 1, wherein:

the inner wall of said structure converges on curve from about 13° at 1.5 diameters stand-off to about 30° at about 0.6 diameters stand-off.

5. A shaped explosive charge enhancement and stand-off according to claim 1, wherein:

the plane of said closed small end is perpendicular to the axis of said frusto-conical structure.

6. A shaped explosive charge enhancement and stand-off according to claim 1, wherein:

said structure is metal and the exterior is covered by concrete.

7. A shaped explosive charge enhancement and stand-off according to claim 1, wherein:

said structure is concrete impervious to ambient conditions.

8. A shaped explosive charge enhancement and stand-off according to claim 1, wherein:

said structure is integral with the structure of the shaped charge.

9. A shaped explosive charge enhancement and stand-off according to claim 1, wherein:

the larger diameter of said structure mates with 80% of the diameter of said cone.

10. A shaped explosive charge enhancement and stand-off according to claim 1, wherein:

said stand-off is of a circular configuration and said cone is of a circular configuration.

11. A shaped explosive charge enhancement and stand-off according to claim 1, wherein:

the cone is of an elongated chevron shape and said stand-off structure is formed of elongated walls mating with the chevron structure producing an enhanced elongated, linear jet.

12. A shaped explosive charge enhancement and stand-off according to claim 1, wherein:

said structure is metal and separable from the shaped charge, and means for securing the two together in axial alignment.

13. A shaped explosive charge enhancement and stand-off according to claim 1, wherein:

the converging walls of said structure terminate so as to lie beyond the cross-section of the generated jet and not touch such a generated jet.

14. A shaped explosive charge enhancement and stand-off according to claim 1, wherein:

handling means are formed in the structure of said stand-off structure.

15. A shaped explosive charge enhancement and stand-off structure in which the shaped charge has a cone on the order of about 60°, comprising in combination with a housing for the explosive having the cone lined.

(a) a frusto-conical rigid structure having its small end about two-thirds of the diameter of the base of the cone and perpendicular to the longitudinal axis of the cone, and its larger end about the same area as the base of the cone and perpendicular to the longitudinal axis of the cone and arranged to register with the base of the cone, (b) the longitudinal axis of the frusto-conical structural being coincidental with the longitudinal axis passing through the cone, (c) the inside wall of said frusto-conical structure being smooth in a longitudinal direction, so as to provide an unhindered path for gases travelling longitudinally along the wall, (d) means for securing said structure to the shaped charge, and (e) the inner wall of said structure converging from its large to its small end at a closing angle ranging about 11.5°–14° at 1.5 cone diameters stand-off to a closing angle of about 30° at from about 0.575 to about 0.7 diameters stand-off and arranged so that no portion of a generated jet particulates contacts the inner wall, and the velocity of the generated jet is increased to produce substantially increased penetration in a target material.

16. A shaped explosive charge enhancement and stand-off structure in which the shaped charge has a cone on the order of about 60°, comprising in combination with a housing for the explosive having the cone lined.

(a) a frusto-conical rigid structural having its small end about two-thirds of the diameter of the base of the cone and perpendicular to the longitudinal axis of the cone, and its larger end about the same area as the base of the cone and perpendicular to the longitudinal axis of the cone and arranged to register with the base of the cone, (b) the longitudinal axis of the frusto-conical structural being coincidental with the longitudinal axis passing through the cone, (c) the inside wall of said frusto-conical structure being smooth in a longitudinal direction, so as to provide an unhindered path for gases travelling longitudinally along the wall, (d) means for securing said structure to the shaped charge, and (e) the inner wall of said structure converging from its large to its small end at a closing angle of 19° at 1.0 cone diameters stand-off and arranged so that no portion of a generated jet particulates contacts the inner wall, and the velocity of the generated jet is increased to produce substantially increased penetration in a target material.

17. A shaped explosive charge enhancement and stand-off according to claim 1, wherein:

the maximum diameter of the stand-off is not less than 80% of the maximum diameter of the cone and the maximum diameter of the cone is not less than 80% of the maximum diameter of the stand-off.

* * * * *